US007114342B2

(12) United States Patent
Oldham et al.

(10) Patent No.: US 7,114,342 B2
(45) Date of Patent: Oct. 3, 2006

(54) PRESSURE MANAGEMENT SYSTEM FOR LIQUEFIED NATURAL GAS VEHICLE FUEL TANKS

(75) Inventors: Robert W. Oldham, Evanston, WY (US); Mark B. Oldham, Evanston, WY (US)

(73) Assignee: Harsco Technologies Corporation, Fairmont, MN (US)

( * ) Notice: Subject to any disclaimer, the term of this patent is extended or adjusted under 35 U.S.C. 154(b) by 0 days.

(21) Appl. No.: 10/950,120

(22) Filed: Sep. 24, 2004

(65) Prior Publication Data

US 2006/0010882 A1 Jan. 19, 2006

Related U.S. Application Data

(60) Provisional application No. 60/506,339, filed on Sep. 26, 2003.

(51) Int. Cl.

| | |
|---|---|
| ***F17C 7/04*** | (2006.01) |
| ***F17C 9/02*** | (2006.01) |
| ***F17C 7/02*** | (2006.01) |
| ***F17C 9/04*** | (2006.01) |

(52) U.S. Cl. ..... 62/48.1; 62/50.1; 62/50.4

(58) Field of Classification Search ..... 62/48.1, 62/50.1, 50.4

See application file for complete search history.

(56) References Cited

U.S. PATENT DOCUMENTS

| | | | | |
|---|---|---|---|---|
| 4,080,800 | A * | 3/1978 | Spaulding et al. | 62/50.4 |
| 4,406,129 | A * | 9/1983 | Mills | 62/7 |
| 4,412,538 | A * | 11/1983 | Yamauchi et al. | 606/22 |
| 5,404,918 | A | 4/1995 | Gustafson | |
| 5,421,161 | A | 6/1995 | Gustafson | |
| 5,687,776 | A * | 11/1997 | Forgash et al. | 141/11 |
| 6,128,908 | A | 10/2000 | Gustafson | |

* cited by examiner

*Primary Examiner*—William C. Doerrler
(74) *Attorney, Agent, or Firm*—David C. Jenkins; Eckert Seamans Cherin & Mellott, LLC

(57) ABSTRACT

A storage and delivery device for a cryogenic liquid that includes a vessel assembly and a delivery line assembly. The vessel assembly has a liquid space and a vapor space. The delivery line assembly has a liquid line, a vapor line, and a delivery line. The liquid line is in fluid communication with the liquid space. The vapor line is in fluid communication with the vapor space. The liquid line has a flow control device located thereon and structured to control the flow of fluid through the liquid line. The liquid line flow control device is structured to close the liquid line when the vessel assembly is at a predetermined pressure.

14 Claims, 1 Drawing Sheet

PRESSURE MANAGEMENT SYSTEM FOR LIQUEFIED NATURAL GAS VEHICLE FUEL TANKS

CROSS REFERENCE TO RELATED APPLICATION

This application claims priority under 35 U.S.C. §119(e) to U.S. Provisional Patent Application Ser. No. 60/506,339, filed Sep. 26, 2003, entitled PRESSURE MANAGEMENT SYSTEM FOR LIQUEFIED NATURAL GAS VEHICLE FUEL VESSELS.

BACKGROUND OF THE INVENTION

1. Field of the Invention

This invention relates to a cryogenic fluid storage system and, more specifically, to a cryogenic fluid storage system having a check valve on the vapor line at a location between the vapor space and the use device.

2. Background Information

Cryogenic liquids, such as liquid natural gas (LNG), nitrogen, oxygen, $CO_2$, hydrogen and the like, are substances that normally exist as gasses, but are liquids at cold temperatures. Special vessels and systems must be used to store and transfer cryogenic liquids because of difficulty in maintaining the extremely cold temperatures. Such vessels typically include a double walled vessel having a vacuum in the annular space. While the vacuum provides an effective insulation, the insulation is not perfect and, as such, heat penetrates the vessel. When heat is added to the cryogenic liquid, a portion of the liquid returns to the gaseous state. The gas within the vessel increases the internal pressure. The build up in pressure may even occur when liquid is being removed from the vessel and being delivered to a use device, such as an engine. Eventually, to prevent over pressurization of the vessel, the gas must be removed from the vessel. It is desirable, however, to not waste the gas by venting the gas to the atmosphere. That is, if possible, it is desirable to use the vented gas in the use device.

For example, where the cryogenic liquid is LNG, the use device is typically an engine. The following description shall use the example of LNG and an engine, but it is understood that the system described herein is applicable to any cryogenic liquid and any use device. The fuel system for the engine includes the cryogenic vessel, a delivery line extending from the cryogenic vessel to the engine, a vaporizer on the delivery line and an economizer circuit. Within the cryogenic liquid vessel are a liquid space and a gas, or vapor, space. The delivery line includes a portion adjacent to the vessel that, in normal operation, contains the cryogenic liquid, hereinafter, the "liquid line." The liquid line is in fluid communication with the cryogenic vessel liquid space. The economizer circuit, or vapor line, is in fluid communication with both the cryogenic vessel vapor space and the liquid line. Down stream of this joint between the liquid line and the vapor line, the delivery line may contain liquid, gas, or a combination of liquid and gas. Because the engine uses the natural gas in a gaseous state, a vaporizer may be located upstream of the engine.

In normal operation, if the vessel does not have a sufficient pressure, a small quantity of cryogenic liquid may be removed from the liquid space, passed through a vaporizer where it is converted to gas, and returned to the vapor space of the cryogenic liquid vessel. Alternatively, when the engine is not running, any excess cryogenic liquid from within the delivery line is allowed to evaporate and is returned to the vapor space through the vapor line of the economizer circuit. This gas pressurizes the cryogenic liquid vessel so that, when the engine is running, the pressure within the vessel causes the cryogenic liquid to exit the vessel to be delivered to the engine. Once the vessel is pressurized the delivery line may be opened to deliver LNG to the vaporizer or engine. Within the vessel, the vapor and the cryogenic liquid are at the same pressure. However, due to the additional pressure created by the weight of the cryogenic liquid, there is a slightly higher pressure acting on the liquid line. Thus, the path of least resistance to fluid flow is through the liquid portion of the delivery line and, when both the economizer circuit and the delivery line are open, fluid will flow from the liquid space within the vessel. Alternatively, the economizer circuit vapor line may include a regulator structured to close when the pressure in the vessel is below a set limit. This ensures that the liquid line is the path of least resistance.

As noted above, heat causes the cryogenic liquid within the cryogenic liquid vessel to be converted to gas and may cause an undesired increase in pressure. That is, the vessel may become over-pressurized. In this situation, gas must be removed from the vapor space to prevent a catastrophic failure of the vessel. One method of removing gas is to simply vent the gas to the atmosphere. This, of course, results in wasted gas. To prevent the venting of gas to the atmosphere when the cryogenic vessel is over-pressurized, gas may be removed from the vapor space within the cryogenic vessel and delivered to the engine. While a direct connection between the cryogenic vessel vapor space and the engine is possible, more typically, the gas is withdrawn through the economizer circuit. That is, because the economizer circuit is in fluid communication with the delivery line, high pressure gas may be transferred through the vapor line to the delivery line and then to the end use. Thus, when the pressure within the vessel exceeds a set limit, the regulator on the economizer circuit vapor line opens allowing gas to flow from the vapor space to the delivery line. However, because the pressure in the vapor line and the liquid space is, essentially, equal, and because the vapor line is also connected to the liquid line, there must be a device on the liquid line to increase the back pressure so that the vapor line is the path of least resistance for the fluid flow. Typically, flow of the cryogenic liquid within the liquid line is reduced by a pressure relief valve, or a restricted orifice, structured to create a back pressure in the liquid line. This additional back pressure ensures that, when the economizer circuit vapor line regulator is open, the vapor line is the path of least resistance and gas within the vapor space is expelled through the economizer circuit to be delivered to the engine, thereby reducing the pressure within the cryogenic vessel. See, e.g., U.S. Pat. No. 5,421,161.

The disadvantage of this system is that the flow of cryogenic liquid is not stopped when the regulator is open. That is, even in an over-pressurization situation, the pressure relief valve or a restricted orifice allows liquid to move through the delivery line. Because the use device is receiving fluid from both the vessel liquid space and vapor space, the speed of pressure reduction is slower than if the use device was receiving fluid from the vapor space only.

There is, therefore a need for a cryogenic liquid storage vessel structured to rapidly reduce the internal pressure while delivering the gas from the vapor space to the use device.

There is a further need for a cryogenic liquid storage vessel structured to rapidly reduce the internal pressure in the cryogenic liquid storage vessel that stops the flow of cryogenic liquid through the delivery line while gas from the vapor space is being delivered to the use device.

SUMMARY OF THE INVENTION

These needs, and others, are met by the present invention which provides a storage and delivery device for a cryogenic liquid having a vessel assembly, with an inner shell and an outer shell, and a delivery line assembly having a liquid line with a regulator, a vapor line with a check valve, and a delivery line. The vessel assembly is preferably an elongated, liquid natural gas (LNG) vessel that is positioned with the longitudinal axis in a generally horizontal plane. When the vessel assembly is filled with a cryogenic liquid, such as, but not limited to, LNG, there is a liquid space and a vapor space. The liquid line is in fluid communication with the liquid space, while the vapor line is in fluid communication with the vapor space. The liquid line includes a two-way regulator. The vapor line includes a check valve. Down stream of both the two-way regulator and the check valve, the liquid line and the vapor lines are coupled at a T-joint to form the delivery line. The delivery line is further coupled to a use device, such as, but not limited to, a vaporizer or an engine. The regulator is structured to close when the pressure in the vessel reaches, or exceeds, a predetermined amount. The check valve prevents vapor flow into the vessel assembly from downstream, and is structured to open when a predetermined pressure difference exists between the vapor space and the delivery line. That is, the check valve does not simply open at a set pressure in the vapor space. As the pressure in the vessel assembly increases due to vapor pressure, the pressure in both the vapor and the liquid line also increases, thus substantially balancing the pressure on both sides of the check valve. The check valve only opens when the regulator closes and there is a pressure drop in the delivery line as the cryogenic liquid is used by the use device or boils away.

In operation, when the vessel assembly is filled with a cryogenic liquid, a portion of the liquid in the vessel boils off to fill the vapor space. During storage of the cryogenic liquid, heat will penetrate the vessel and cause additional liquid to boil off, thereby increasing the pressure in the system. If the increase is beyond a set point, the gas will be released to the atmosphere via a relief valve. However, if the use device is being used while the vessel is at a high pressure, it is desirable to have the gas drawn from the vapor space, thereby decreasing the pressure in the system without venting the gas to the atmosphere. The regulator is structured to close when the system is at high pressure. Thus, the liquid line is closed when the system is at high pressure and, after any residual cryogenic liquid in the liquid line boils off, gas must be removed from the vapor space. This is accomplished by having the check valve structured to open when the difference in pressure between the vapor space and the delivery line reaches a set point as described above. Thus, the delivery line assembly ensures that gas is removed from the vapor space only when the liquid line is closed at the regulator.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
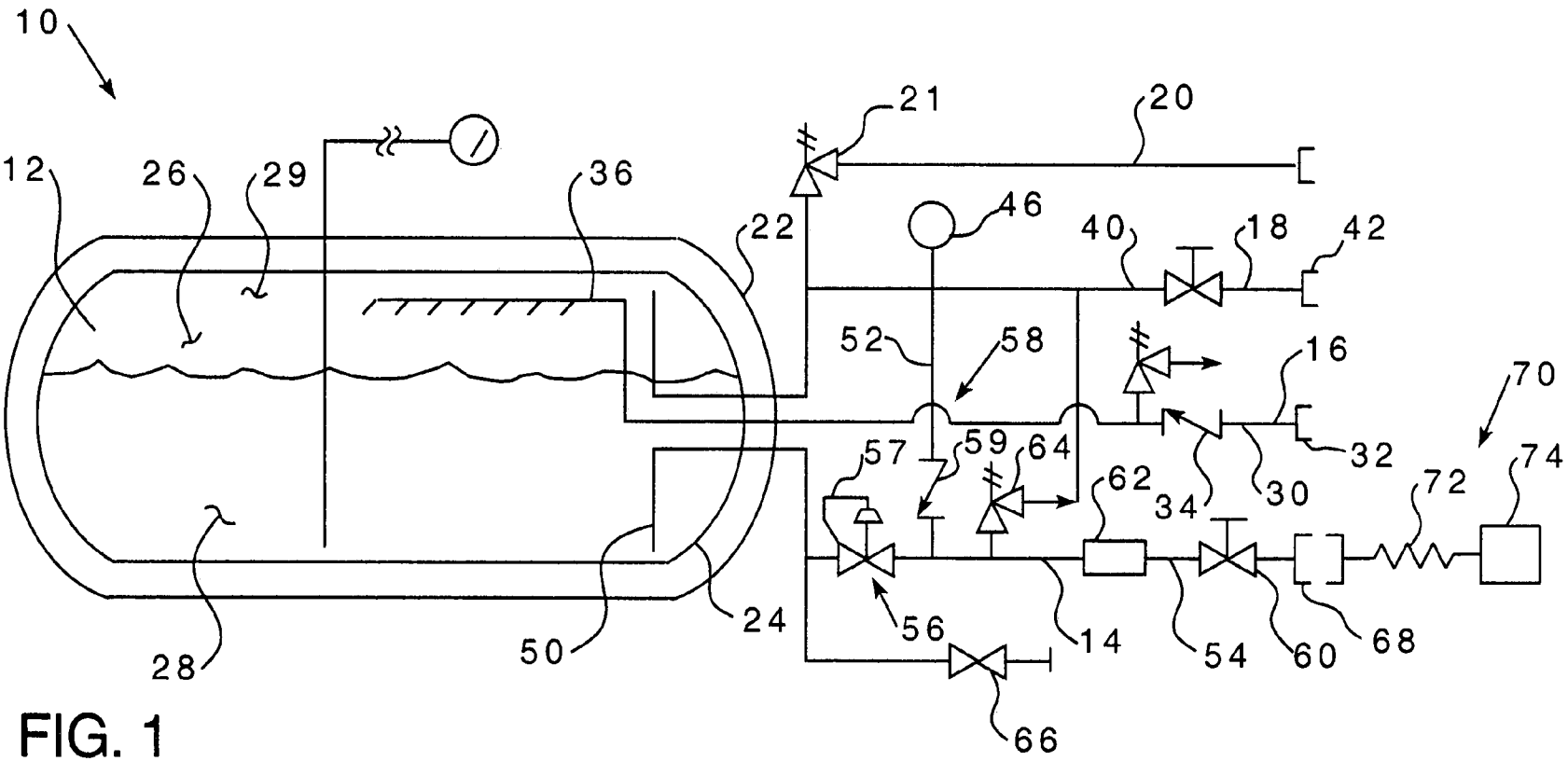
FIG. 1 is a schematic view of the vessel assembly of the present invention.

As shown in FIG. 1, a storage and delivery device 10 for a cryogenic liquid having a vessel assembly 12, a delivery line assembly 14, a fill line assembly 16, a vent line assembly 18, and an emergency vent line 20. The vessel assembly 12 includes a first, outer vessel shell 22 and a second, inner vessel shell 24. The inner vessel shell 24 defines a storage space 26 for the cryogenic liquid. Within the storage space 26 is a liquid space 28 and a vapor space 29. Between the first, outer vessel shell 22 and the second, inner vessel shell 24 is, preferably, a vacuum that acts as an insulating layer.

The fill line assembly 16 is structured to deliver a cryogenic fluid into the storage space 26. The fill line assembly 16 includes a fill line 30, a coupling device 32, a check valve 34 structured to prevent back flow out of the fill line 30 and a spray device 36. The fill line 30 extends from a point outside of the vessel assembly 12 to a point inside the storage space 26. The spray device 36 is disposed inside the storage space 26 and, during filling operations, helps collapse the pressure head in the storage space 26.

The vent line assembly 18 includes a vent line 40, a coupling device 42 and a valve 44. The vent line assembly 18 may include a pressure gage 46 coupled to the vent line 40 structured to indicate the pressure within the storage space 26. The vent line 40 extends from a point outside of the vessel assembly 12 to a point inside the storage space 26, and more specifically the vapor space 29. The emergency vent line 20 is a spur line off of the vent line 40 that does not pass through the vent line valve 44. The emergency vent line 20 includes a relief device 21 such as, but not limited to, a relief valve or burst disk. The relief device 21 is actuated when the pressure within the vessel assembly 12 exceeds a predetermined pressure, preferably about 230 psi.

The delivery line assembly 14 includes a liquid line 50, a vapor line 52, and a delivery line 54. The liquid line 50 is in fluid communication with the liquid space 28. The vapor line 52 is in fluid communication with the vapor space 29, and may be in fluid communication with the vent line 40. The liquid line 50 and the vapor line 52 join in fluid communication to form the delivery line 54. The liquid line 50 has a flow control device 56 located thereon which is structured to control the flow of fluid through the liquid line 50, including closing the liquid line 50. Preferably, the liquid line flow control device 56 is a regulator 57. The vapor line 52 has a flow control device 58 located thereon which is structured to control the flow of fluid through the vapor line 52, including closing the vapor line 52. Preferably, the vapor line flow control device 58 is a check valve, such as, but not limited to, a spring check valve, a flap valve, a ball valve, or a differential check valve. The delivery line assembly 14 further includes a valve 60, an excess flow valve 62, a relief valve 64 which is coupled to the vent line 40, a drain valve 66, and a coupling 68. The delivery line coupling 68 is structured to be joined to a use device 70, that may include, but is not limited to an evaporator 72 and/or an engine 74.

The liquid line flow control device 56 is structured to close the liquid line 50 when the vessel assembly 12 is at a predetermined pressure. Preferably, the liquid line flow control device 56 closes the liquid line 50 when the when the vessel assembly 12 pressure is between about 50 and 200 psi, and more preferably at a pressure of about 125 psi. When the vessel assembly 12 pressure is below the predetermined pressure to actuate the liquid line flow control device 56, the liquid line flow control device 56 is open. The vapor line flow control device 58 is structured to open the vapor line 52 when the vessel assembly 12 is at a predetermined pressure and the delivery line 54 is at a predetermined lower pressure. The difference of the pressure in the vessel assembly 12 and the delivery line 54 is hereinafter identified as "vapor line pressure differential." Preferably, the vapor line flow control device 58 opens the vapor line 52 when the vapor line pressure differential is between about 1 and 50 psi, and more preferably at a vapor line pressure differential of about 10 psi. When the vapor line pressure differential is below the predetermined vapor line pressure differential to actuate the vapor line flow control device 58, the vapor line flow control device 58 is closed.

In this configuration, after the vessel assembly 12 is filled with a cryogenic liquid and pressurized as described above, a cryogenic fluid may be delivered to the use device 70 coupled to the delivery line assembly 14 by opening the delivery line assembly valve 60. When the vessel assembly 12 is at low or normal operating pressure, the vapor line flow control device 58 is closed and the liquid line flow control device 56 is open. Thus, pressure within the vessel assembly 12 causes the cryogenic fluid to exit the vessel assembly 12 via the liquid line 50 and then to the delivery line 54. If heat transferred to the vessel assembly 12 causes the cryogenic fluid within the vessel assembly 12 to vaporize and increase the internal pressure of the vessel assembly 12 beyond the predetermined pressure to actuate the liquid line flow control device 56, the liquid line flow control device 56 closes the liquid line 50. At this point, cryogenic fluid in the delivery line 54 is used by the use device 70 or vented through the vent line assembly 18. As the pressure in the delivery line 54 drops, the vapor line pressure differential increases to a point where the vapor line flow control device 58 is actuated, that is, opened, thereby opening the vapor line 52. Thus, the cryogenic fluid, as a gas, passes through the vapor line 52 to the delivery line 54. As the gas is removed from the vapor space 29, pressure within the vessel assembly 12 is reduced below the predetermined vapor line pressure differential sufficient to actuate the vapor line flow control device 58. Thus, the vapor line flow control device 58 is closed. Similarly, once the vessel assembly 12 pressure is below the predetermined pressure to actuate the liquid line flow control device 56, the liquid line flow control device 56 is opened and the pressure within the vessel assembly 12 causes the cryogenic fluid to exit the vessel assembly 12 via the liquid line 50 and then to the delivery line 54.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A storage and delivery device for a cryogenic liquid comprising:

a vessel assembly having a liquid space and a vapor space;

a delivery line assembly having a liquid line, a vapor line, and a delivery line;

said liquid line in fluid communication with said liquid space, said vapor line in fluid communication with said vapor space;

said liquid line having a flow control device located thereon and structured to control the flow of fluid through said liquid line;

wherein said liquid line flow control device is structured to close said liquid line when said vessel assembly is at a predetermined pressure;

said vapor line having a flow control device located thereon and structured to control the flow of fluid through said vapor line; and wherein said vapor line flow control device is structured to open only when said liquid line flow control device is closed.

2. The storage and delivery device for a cryogenic liquid of claim 1 wherein said liquid line flow control device is a regulator.

3. The storage and delivery device for a cryogenic liquid of claim 2 wherein said regulator is structured to close when said vessel pressure is between about 50 and 200 psi.

4. The storage and delivery device for a cryogenic liquid of claim 2 wherein said regulator is structured to close when said vessel pressure is about 125 psi.

5. The storage and delivery device for a cryogenic liquid of claim 1 wherein said vapor line flow control device is a check valve.

6. The storage and delivery device for a cryogenic liquid of claim 5 wherein said check valve is structured to open when the vapor line pressure differential is between about 1 and 50 psi.

7. The storage and delivery device for a cryogenic liquid of claim 5 wherein said check valve is structured to open when the vapor line pressure differential is about 10 psi.

8. The storage and delivery device for a cryogenic liquid of claim 5 wherein said check valve is a spring check valve.

9. A storage and delivery device for a cryogenic liquid comprising:

a vessel assembly having a liquid space and a vapor space;

a delivery line assembly having a liquid line, a vapor line, and a delivery line;

said liquid line in fluid communication with said liquid space, said vapor line in fluid communication with said vapor space;

said liquid line having a regulator;

said vapor line having a check valve; and wherein said liquid line and said vapor line are coupled in fluid communication down stream of said regulator and said check valve to form said delivery line.

10. The storage and delivery device for a cryogenic liquid of claim 9 wherein said regulator is structured to close when said vessel pressure is between about 50 and 200 psi.

11. The storage and delivery device for a cryogenic liquid of claim 10 wherein said regulator is structured to close when said vessel pressure is about 125 psi.

12. The storage and delivery device for a cryogenic liquid of claim 9 wherein said check valve is structured to open when the vapor line pressure differential is between about 1 and 50 psi.

13. The storage and delivery device for a cryogenic liquid of claim 12 wherein said check valve is structured to open when the vapor line pressure differential is about 10 psi.

14. The storage and delivery device for a cryogenic liquid of claim 9 wherein the check valve is a check valve selected from the group consisting of: a spring check valve, a flap valve, a ball valve, or a differential check valve.

* * * * *